US009398815B2

(12) United States Patent
Stitchick et al.

(10) Patent No.: US 9,398,815 B2
(45) Date of Patent: Jul. 26, 2016

(54) COT

(71) Applicant: Foundations Worldwide, Inc., Medina, OH (US)

(72) Inventors: David Stitchick, Norton, OH (US); Joseph A. Lawlor, Medina, OH (US); Lukasz S. Poslowski, Middleburg Heights, OH (US)

(73) Assignee: FOUNDATIONS WORLDWIDE, INC., Medina, OH (US)

( * ) Notice: Subject to any disclaimer, the term of this patent is extended or adjusted under 35 U.S.C. 154(b) by 75 days.

(21) Appl. No.: 14/336,386

(22) Filed: Jul. 21, 2014

(65) Prior Publication Data

US 2016/0015181 A1 Jan. 21, 2016

(51) Int. Cl.
*A47D 7/00* (2006.01)

(52) U.S. Cl.
CPC ..... *A47D 7/00* (2013.01)

(58) Field of Classification Search
CPC ..... A47D 7/00; A47D 13/02
USPC ..... 5/110, 111
See application file for complete search history.

(56) References Cited

U.S. PATENT DOCUMENTS

| | | | | | |
|---|---|---|---|---|---|
| 1,308,187 | A * | 7/1919 | Mills | A47C 23/28 | 5/110 |
| 1,856,113 | A * | 5/1932 | Rapprich | A47C 17/705 | 5/111 |
| 3,097,368 | A * | 7/1963 | Collins | A47C 17/66 | 5/110 |
| 3,197,789 | A * | 8/1965 | Ashkouti | A47C 17/66 | 5/110 |
| 4,958,390 | A | 9/1990 | Mendenhall | | |
| 5,003,649 | A | 4/1991 | Kelly | | |
| D328,401 | S | 8/1992 | Kelly | | |
| 5,263,424 | A | 11/1993 | Kelly | | |
| 5,303,438 | A | 4/1994 | Walker | | |
| 5,490,292 | A | 2/1996 | Auburn | | |
| 5,992,348 | A | 11/1999 | Harding | | |
| 6,345,400 | B2 | 2/2002 | Elliott et al. | | |
| 6,513,178 | B1 | 2/2003 | Kelly et al. | | |
| 6,564,400 | B2 * | 5/2003 | Kelly | A47D 7/00 | 5/110 |
| 6,701,548 | B2 * | 3/2004 | Vigneron | A47D 7/00 | 5/110 |
| 7,086,100 | B1 | 8/2006 | Lo | | |
| 7,237,281 | B2 | 7/2007 | Kelly et al. | | |
| 7,260,856 | B2 | 8/2007 | Kelly et al. | | |
| 7,458,116 | B2 | 12/2008 | Kelly et al. | | |
| 8,739,333 | B2 * | 6/2014 | Boyle | A47C 19/021 | 5/110 |
| D747,116 | S * | 1/2016 | Stitchick | D6/382 | |
| 2005/0039257 | A1 * | 2/2005 | Kelly | A47C 23/24 | 5/110 |
| 2005/0166317 | A1 | 8/2005 | Kelly | | |
| 2013/0133136 | A1 * | 5/2013 | Cheng | A47D 7/00 | 5/282.1 |

* cited by examiner

*Primary Examiner* — Robert G Santos
*Assistant Examiner* — Myles Throop
(74) *Attorney, Agent, or Firm* — Walker & Jocke

(57) ABSTRACT

A cot is provided that has a frame having a shape of a continuous loop. The frame bounds an interior area of the loop and the interior area is covered by a fabric covering. The frame includes an outer perimeter. At least two legs are mounted to the frame and each leg includes a foot portion. The at least two legs are positioned to support the frame above a horizontal floor surface with the foot portions of each leg in contact with the floor surface. Also, each leg extends outwardly and downwardly from the frame such that the foot portions are positioned outwardly of the outer perimeter of the frame in both vertical and horizontal directions.

18 Claims, 10 Drawing Sheets

COT

BACKGROUND

A cot is a small bed. Cots typically have a configuration that enables them to be lightweight and portable. Cots for children, for example, may be used in a day care to provide a comfortable place for children to rest and sleep. Cots for children may benefit from improvements.

SUMMARY

The following is a brief summary of subject matter that is described in greater detail herein. This summary is not intended to be limiting as to the scope of the claims. In one example embodiment of one or more inventions described herein, a cot for a child may comprise a frame having a shape of a continuous loop. Such a continuous loop may have the form of an oval, a rectangle or a rounded rectangle, for example, which bounds an interior area of the loop. The frame also includes an outer perimeter.

In an example embodiment, the interior area is covered by a covering such as a woven fabric. For example, the interior area may be covered by a fabric covering such that there is no aperture through the loop of the frame that is larger than ⅛th of an inch. The absence of larger apertures in such examples of the described cot enables the cot to minimize the opportunity for injuries caused by hair or fingers of a child being caught in holes in the cot. However, it should be appreciated that in alternative embodiments, the cot may include larger apertures through the loop of the frame that are not covered by the fabric covering.

The cot may include at least two legs that are mounted to the frame. The lower portion of a leg that contacts the floor is referred to herein as the foot portion of the leg. In this example, the at least two legs are positioned to support the frame above a horizontal floor surface with the foot portions of each leg in contact with the floor surface. Also, each leg extends outwardly and downwardly from the frame such that the foot portions are positioned outwardly of the outer perimeter of the frame in both vertical and horizontal directions.

In an example embodiment, the frame may include four spaced apart rounded corner portions, to which four legs may be respectively mounted. However, it should be appreciated that in alternative embodiments, less or more than four legs may be mounted to the frame. For example, two legs may be mounted to opposite ends of the cot which have a sufficient width to prevent the cot from being tipped over by a child sitting on an edge of the cot.

In these described embodiments, each leg includes a mounted end that is connected to the frame. The mounted end of each leg includes a channel and portions of the frame (such as curved portions or curved corner portions of the frame) extend in the channels of the legs. In embodiments with four legs, the corner portions of the frame have a curvature in a horizontal direction when the foot portions of each leg are in contact with the horizontal floor surface. Also, the channel of the mounted end of each leg may include an inner wall that is curved in the horizontal direction. Such a curvature in the horizontal direction generally corresponds to the curvature of the corner portion of the frame that extends in the channel of the mounted end of each leg. However, in alternative embodiments, the channel in the mounted end of the leg may be straight or have other contours depending on the shape of the portion of the frame to which it is mounted.

The mounted end of each leg may include an upper and a lower flange that forms the described channel in the mounted end. The mounted end of each leg may also include two spaced apart apertures that are positioned on opposed sides of the channel respectively through the upper and lower flanges of the mounted end. Each leg may also include at least one fastener (such as a rivet) that is positioned to extend through the at least two spaced apart apertures and through the corner portion of the frame to which the mounted end is connected.

However, it should also be appreciated that each leg may include more than one fastener. For example, the mounted end of each leg may include at least two sets of the two spaced apart apertures through the upper and lower flanges of the mounted end. The at least two sets may be spaced apart along the channel of the mounted end of each leg in the horizontal direction. Each of these two sets may include a fastener (such as a rivet) that extends through the apertures in each set and through the frame of the cot.

Each leg mounted to the cot includes an outer surface that faces outwardly from the frame. In an example embodiment, the outer surface of each leg may include a channel that extends between the mounted end and the foot portion of the leg. Such a channel may be narrower in width adjacent the foot than adjacent the mounted end. Also, in this example, the outer surfaces adjacent the channel may be generally curved and the portions of the outer surface that defines the channel may include generally flat portions. In addition, the foot of each leg may be wider than the mounted end of each leg. These features of the cot may enable multiple copies of the cot to be stacked in a compact manner in which the legs of an upper cot extend over the outer surfaces of the legs of a lower cot in the stack.

However, it should be appreciated that in alternative embodiments, the contours of the legs of the cot may have other shapes that are sufficient to support the frame when a child is resting thereon while also placing the feet of the legs outwardly of the outer perimeter of the frame in both vertical and horizontal directions so as to enable the cot to be compactly stacked. Other aspects will be appreciated upon reading and understanding the attached figures and description.

DETAILED DESCRIPTION

Figure 1:
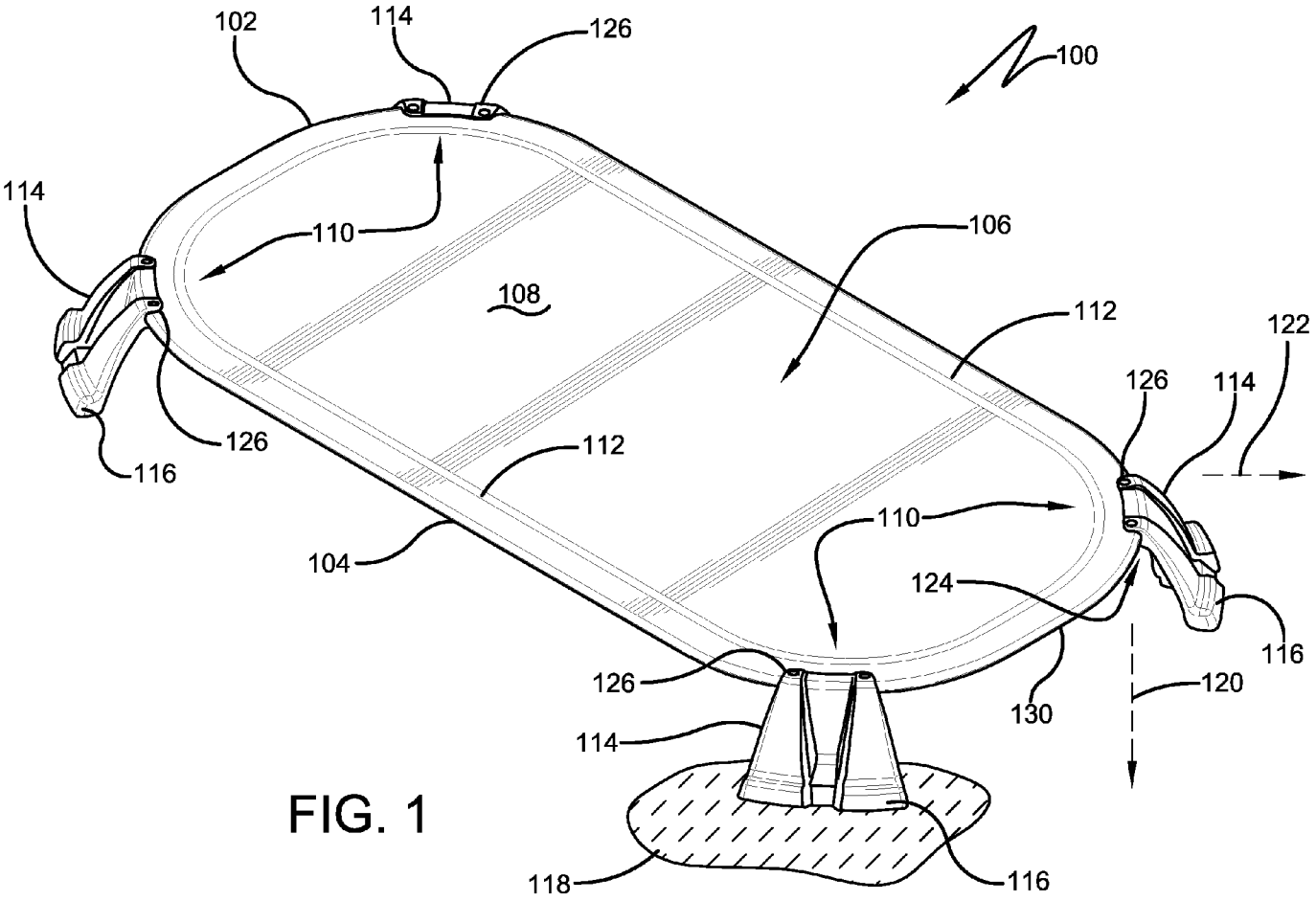
FIG. 1 is an isometric view of an example cot for a child.

Various technologies pertaining to cots for children will now be described with reference to the drawings, where like reference numerals represent like elements throughout. It is to be understood that functionality that is described as being carried out by certain components may be performed by multiple components. Similarly, for instance, a component may be configured to perform functionality that is described as being carried out by multiple components.

With reference to FIG. 1, an isometric view 100 of an example cot 102 that provides a resting platform for a child is illustrated. The cot may include a frame such as a tubular frame 104 comprised of steel, aluminum, and/or other metals and materials. Such a tubular frame may extend in a loop that defines a perimeter around an interior area. For example, the frame 104 shown in FIG. 1 has the form of a continuous loop having a generally rectangular shape with rounded corners 110. However, it should be appreciated that in alternative embodiments, the frame 104 may have other shapes such as an oval shape, a circular shape, or any other shape in which the frame extends in a loop that bounds an interior area. In this example, the interior area is the volume of space that is surrounded by the frame.

To provide a comfortable sleeping surface, the described frame may include a covering 108 that traverses the interior area 106. As shown in FIG. 1, the covering may traverse the interior area such that there are no holes/apertures that would enable an object larger than ⅛ of an inch to pass through the covering/interior area between opposed sides of the loop of the frame. The absence of larger holes may be operative to minimize injury to a child caused by a child's finger or hair being caught in the covering.

However, it should be understood, that in alternative embodiments, the covering may not completely traverse the interior area 106 of the frame. For example, in an alternative embodiment, portions of the covering may not extend all the way to the rounded corners 110 of the frame (or other portions of the frame). Also, in further alternative embodiments, the covering itself may include apertures larger than ⅛th of an inch.

Figure 2:
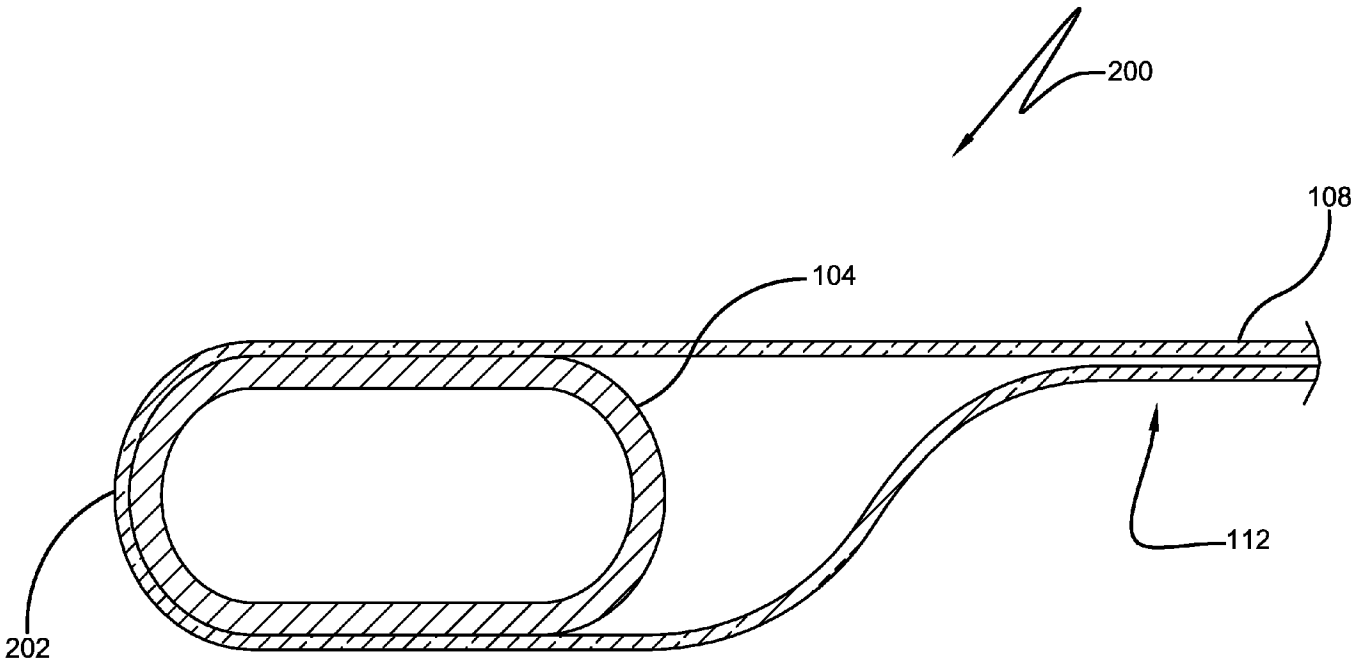
FIG. 2 is a cross-sectional view of a portion of the frame and covering of the cot.

In this described example the covering may wrap around the tubular frame such that the end portions of the covering extend around the outer portions of the frame and are fastened (e.g., stitched, bonded) back onto itself at portions of the covering positioned in the interior area. As a result, the tubular frame is encapsulated (at least in part) by the covering. As shown in FIG. 1, the edges of the material are fastened to the covering (after looping around the frame) at a fastened location 112 in the interior area adjacent the frame 104. To illustrate this construction more clearly, FIG. 2 shows a cross-sectional view 200 of the frame 104 and the covering 108. As shown in FIG. 2, an end portion 202 of the covering extends around the frame 104 and is fastened back to itself at the fastened location 112. The fastening of the covering back to itself may be done via stitching, an adhesive, or with any other fastener or method of bonding that will not cause discomfort to the child resting on the covering.

Figure 3:
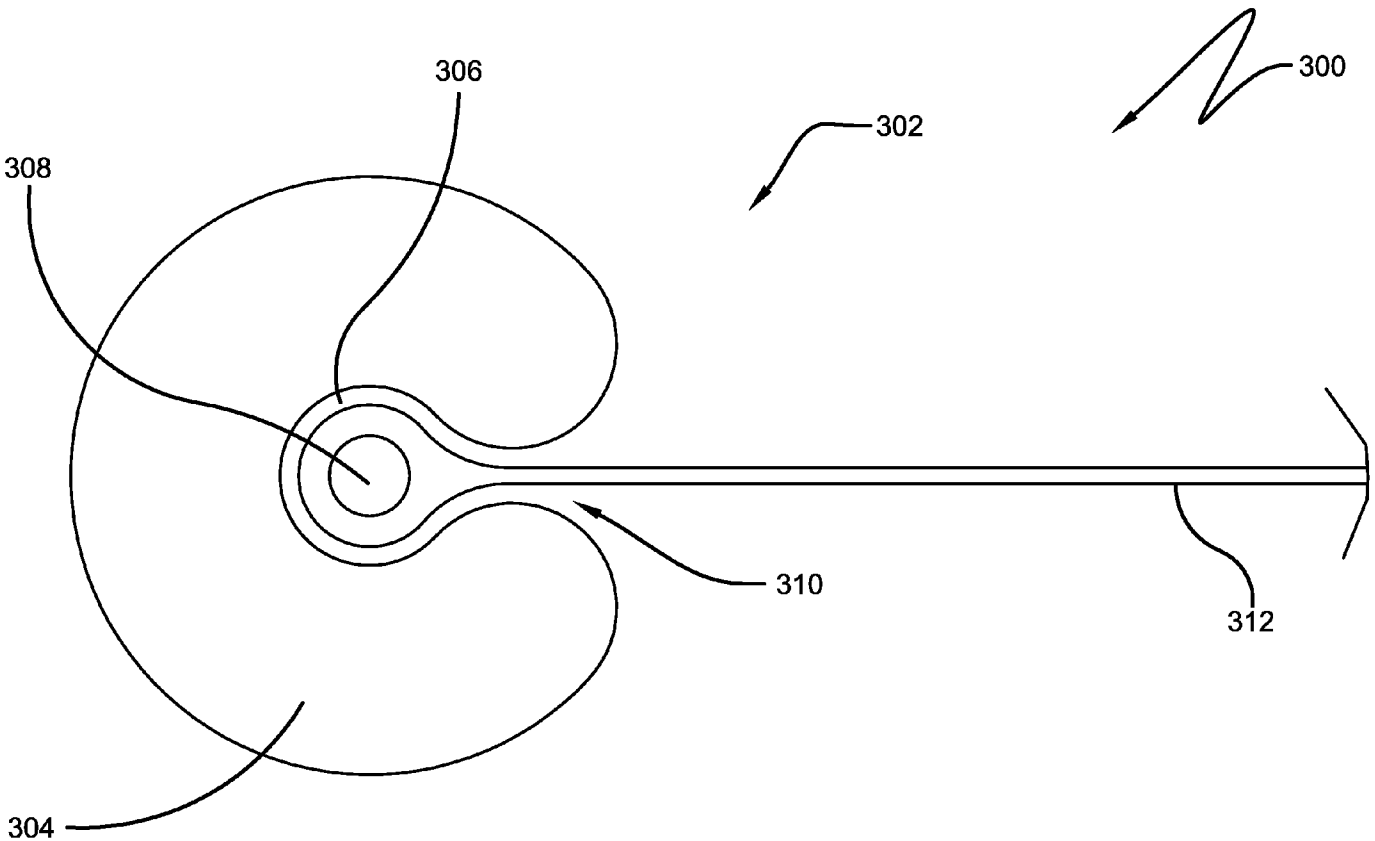
FIG. 3 is a cross-sectional view of an alternative example of a portion of the frame and covering of the cot.

However, it should be appreciated that in alternative embodiments other methods of attaching a covering to a frame may be used. For example, FIG. 3 illustrates a cross-sectional view 300 for an alternative embodiment of the cot 302. Here the frame 304 of the cot includes a channel 306 in which a rod 308 is located. In this example, an opening 310 to the channel 306 is narrower than the diameter of the rod 308. Thus, the rod is unable to be pulled out of the channel of the frame through the opening 310. In this alternative example, the cot includes a covering 312 that wraps around the rod 308 (rather than wrapping around the frame 304).

In example embodiments of the cot, the covering may be made out of a fabric material (such as a woven fabric) comprised of cotton, polyester, linen, and/or any other material that is sufficiently strong to support a child. In addition, the types and/or blends of fibers and the weave of the fibers used to form the covering may be operative to minimize permanent stretching of the covering in the interior area of the cot caused by the weight of a child lying on the covering. Also, it should be appreciated that the covering may be made out of other flexible materials which may not be woven.

Referring back to FIG. 1, the example cot 102 may include a plurality of legs 114 that are operative to contact a surface of a floor 118 and support the frame and covering above the floor. Such legs may be made out of polypropylene or other moldable plastic or other type of material that is compatible with the features of the leg described herein.

Each leg may include a mounted end 126 that is configured to mount to the outer edges of the rounded corners 110 of the frame. Each leg also extends in a common downward direction 120 and a respective outward horizontal direction 122 from the frame. In other words, each leg extends outwardly and downwardly from the frame 104 such that the foot portion 116 of the leg is positioned outwardly of the outer perimeter 130 of the frame in both vertical 120 and horizontal 122 directions. As a result, substantially all of the space 124 (that is vertically between the portions of the frame to which the mounted ends 126 are attached and the floor surface 118 upon which the legs are supported) is not obstructed by the legs. Rather, only a relatively thin lower portion (e.g., flange) of the mounted end 126 of each leg extends in this space 124 directly below the frame where the mounted end is attached.

In this described example, the portion of a leg that contacts the floor is referred to herein as a foot portion (or simply a foot) 116. As shown in FIG. 1, each foot may be visually distinctive relative to the upper portions of the leg. For example, a foot may be defined by portions of the outer surfaces of the leg that jut outwardly horizontally relative to other upper portions of the leg. However, it should be appreciated that in alternative embodiments, the feet of the legs of the cot may not have a contour that is visually distinctive. Rather, the outer surfaces of an alternative leg may uniformly continue to the bottom surface of the leg. Such a bottom surface of the leg may correspond to the foot of the leg in such embodiments.

Figure 4:
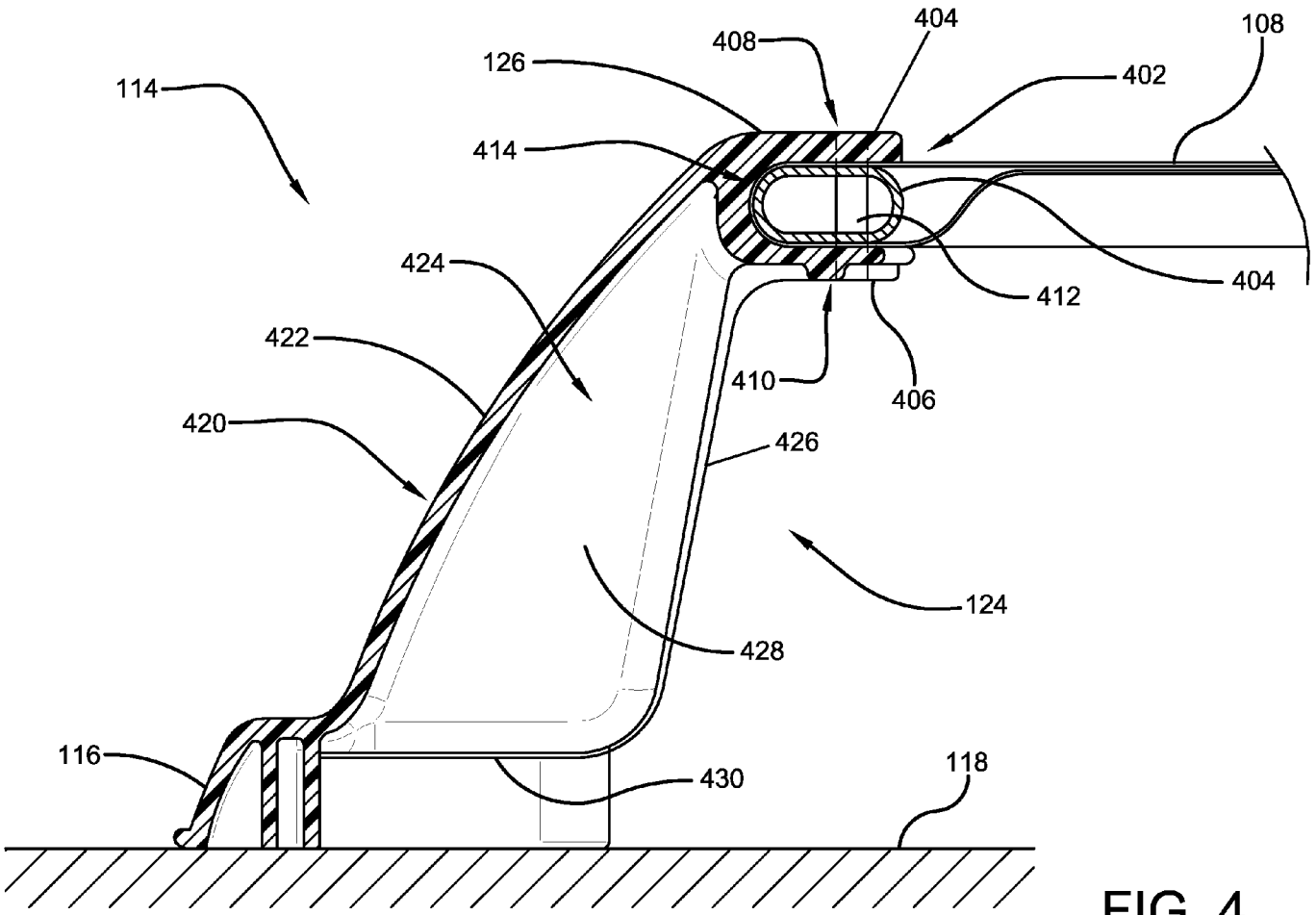
FIG. 4 is a cross-sectional view of a portion of the frame, covering and a leg of the cot.

FIG. 4 shows a cross-sectional view 400 of the leg 114 of the cot. In this example, the mounted end 126 of the leg includes a channel 402 that is configured to receive a portion of the frame 104 therein. The channel 402 may be bounded by upper and lower flanges 404, 406. These flanges may include one or more apertures 408, 410 through which at least one fastener 412 (e.g., rivet, bolt, screw) is positioned to extend through corresponding apertures in the frame.

Figure 5:
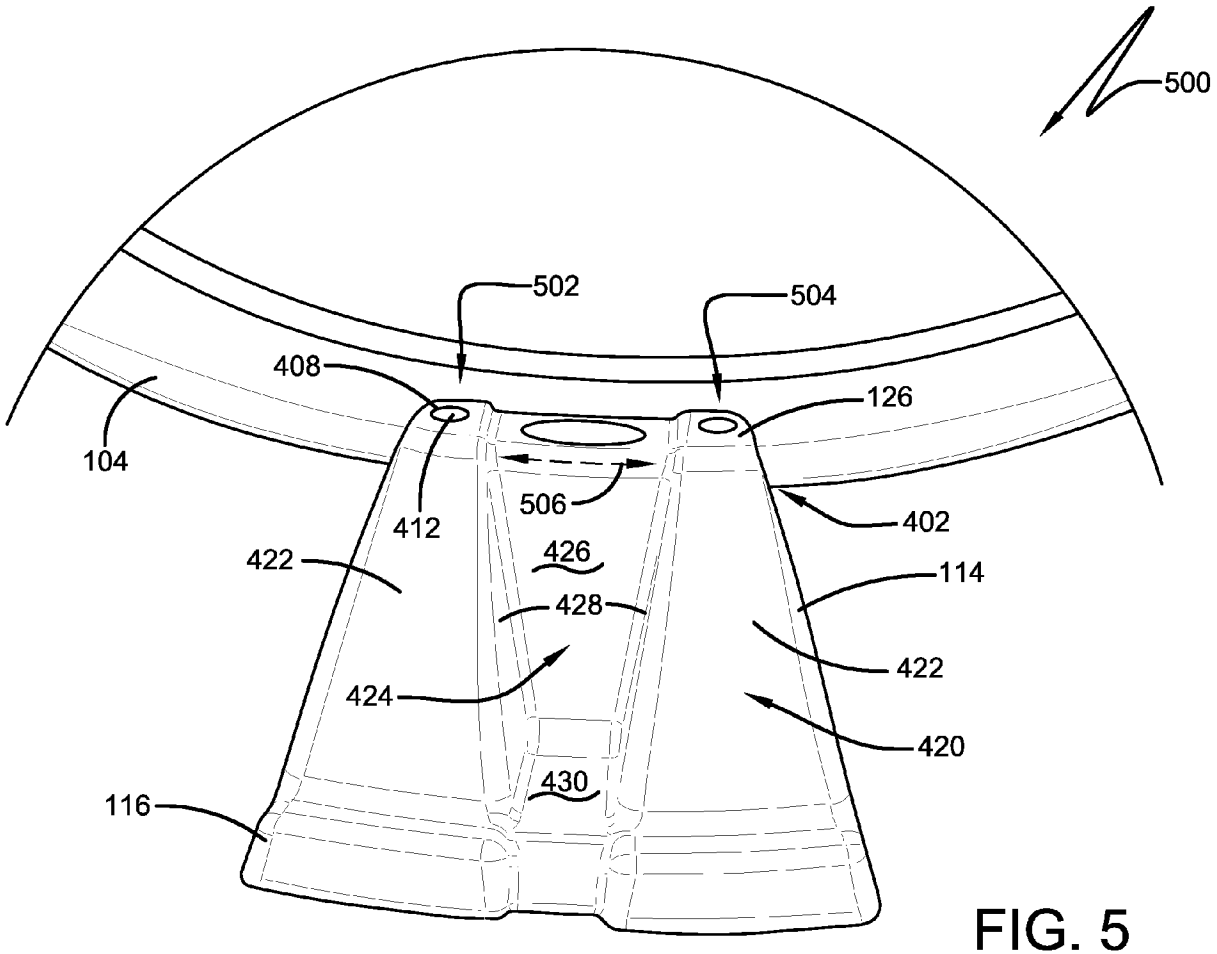
FIG. 5 is an isometric view of the outside surface of the leg of the cot.
Figure 6:
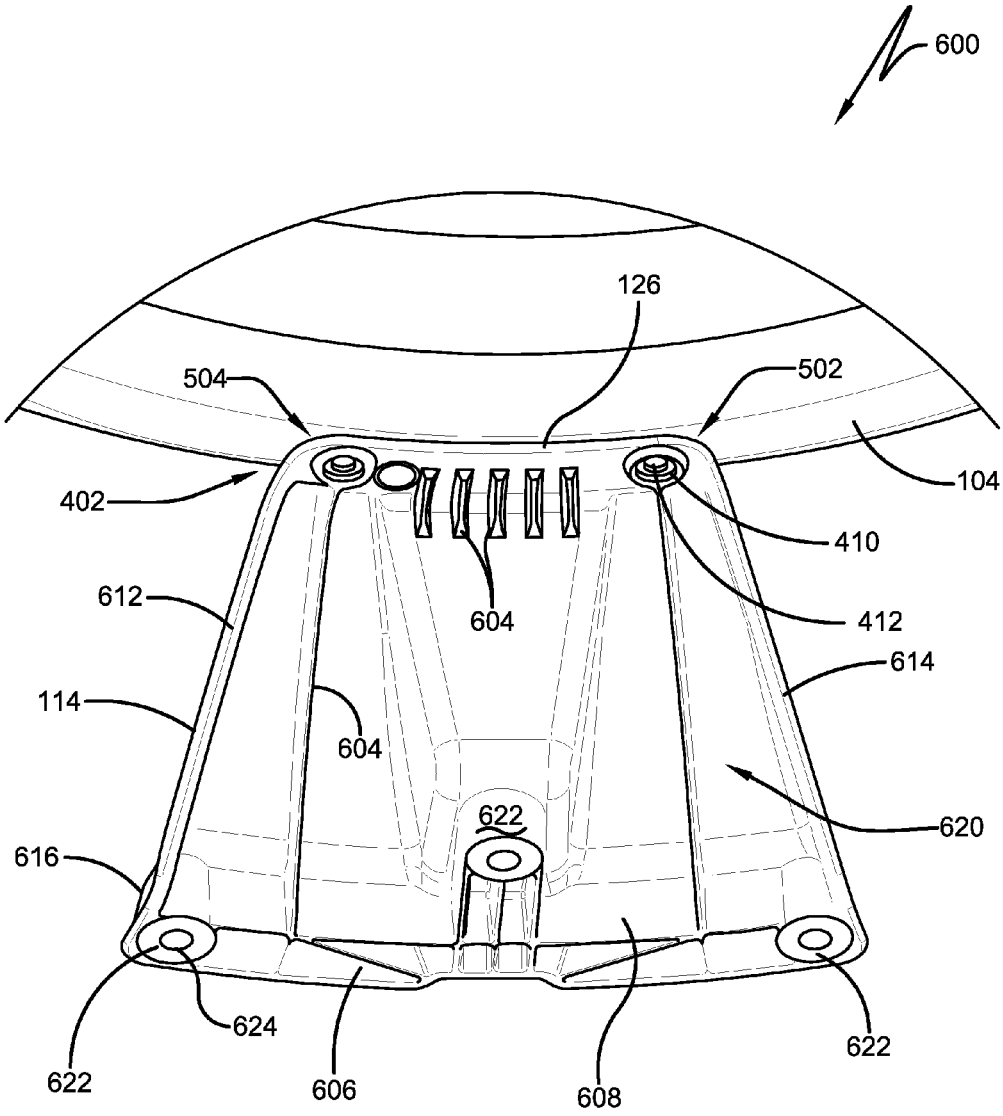
FIG. 6 is an isometric view of the inside surface of the leg of the cot.

To illustrate an example configuration of the legs 116 more clearly, FIGS. 5 and 6 show respective front and rear views of one of the described legs. As shown in FIGS. 5 and 6, an example embodiment of the legs may include two sets 502, 504 of apertures that are spaced apart in a horizontal direction along the mounted end 126 of the leg.

Referring back to FIG. 4, in an example embodiment, the channel 402 in the mounted end 126 that receives portions of the tubular frame 104 therein may include an inner wall 414 that has a shape that corresponds to the shape (i.e., outer curvature) of the frame 104. In this example, the tubular frame has rounded outer edges in cross-section. Thus, the cross-section (in a vertical plane) of the inner wall 414 may have a corresponding rounded contour for at least some of the portions of the inner wall 414 that contact the outer surfaces of the tubular frame.

In addition, as shown in FIG. 1, the rounded corners 110 to which the mounted ends 126 of the legs are attached are rounded/curved in horizontal directions. Thus, as shown schematically in FIG. 5, vertical portions of the inner wall 414 may have a correspondingly curved contour 506 (in horizontal directions), between the two sets of apertures 502, 504 in order to match the curved contour (in the horizontal directions) of the rounded corners 110 of the frame of the cot.

In addition, it should be appreciated that in alternative embodiments, the contours of the inner wall 414 of the channel in the mounted end of the leg may have other shapes (e.g., squared, rectangular, oval). In addition, it should be appreciated that portions of the frame to which the legs are mounted may have other shapes as well. In general, the mounted end of the leg may have any appropriate shape that enables portions of the frame to be rigidly clamped in the channel of the mounted end via fasteners that extend vertically through the flanges of the mounted end and through the frame.

As shown in FIG. 4, it should also be noted that the covering 108 may extend around the tubular frame 104 in the channel 402 as well. However, in alternative embodiments, the covering may be cut so that the covering does not extend around the frame in the locations on the frame that extend into the channels in the mounted ends of the legs.

Referring to FIG. 6, it should be appreciated that example embodiments of the described legs 114 may include a plurality of ribs 602, 604, 606, 608 that extend along the inner surface 620 of the leg. Such ribs may be positioned to enhance the rigidity of the leg and to prevent the leg from crumpling in response to the weight of a child resting on the covered frame of the cot. Side walls 612, 614 that extend from the sides of the inner surface 610 may also increase the rigidity of the leg.

In addition, the foot 616 of the leg may include bosses 622 that are positioned to be adjacent to the floor when the legs are placed on the floor. Such bosses may include threaded apertures 624 therein that are adapted to receive a smooth pad in threaded connection therewith. Such pads (not shown) may be operative to enable the foot of the legs to slide on a smooth, flat floor surface with a reduced amount of friction resistance and in a manner that minimizes scratches to the floor surface.

Referring back to FIG. 4, each leg also includes an outer surface 420. Such an outer surface may include portions 422 that are curved as the outer surface 420 slopes downwardly and outwardly from the mounted end 126 between the mounted end 126 and the foot 116 of the leg. In addition, such an outer surface 420 may include a channel 424 that is set inwardly of the curved portions 422 of the outer surface 420. The portions 426, 428, 430 of the leg that bounds the channel 424 may include surfaces that are less curved and/or are substantially flat compared to the portions 422 that are outside the channel. However, it should be appreciated that in alternative embodiments, these different portions of the outer surface 410 may have other contours (e.g., flat and/or curved). It should be noted that alternative example embodiments may have no outer channel and/or may have more than one outer channel.

Figure 7:
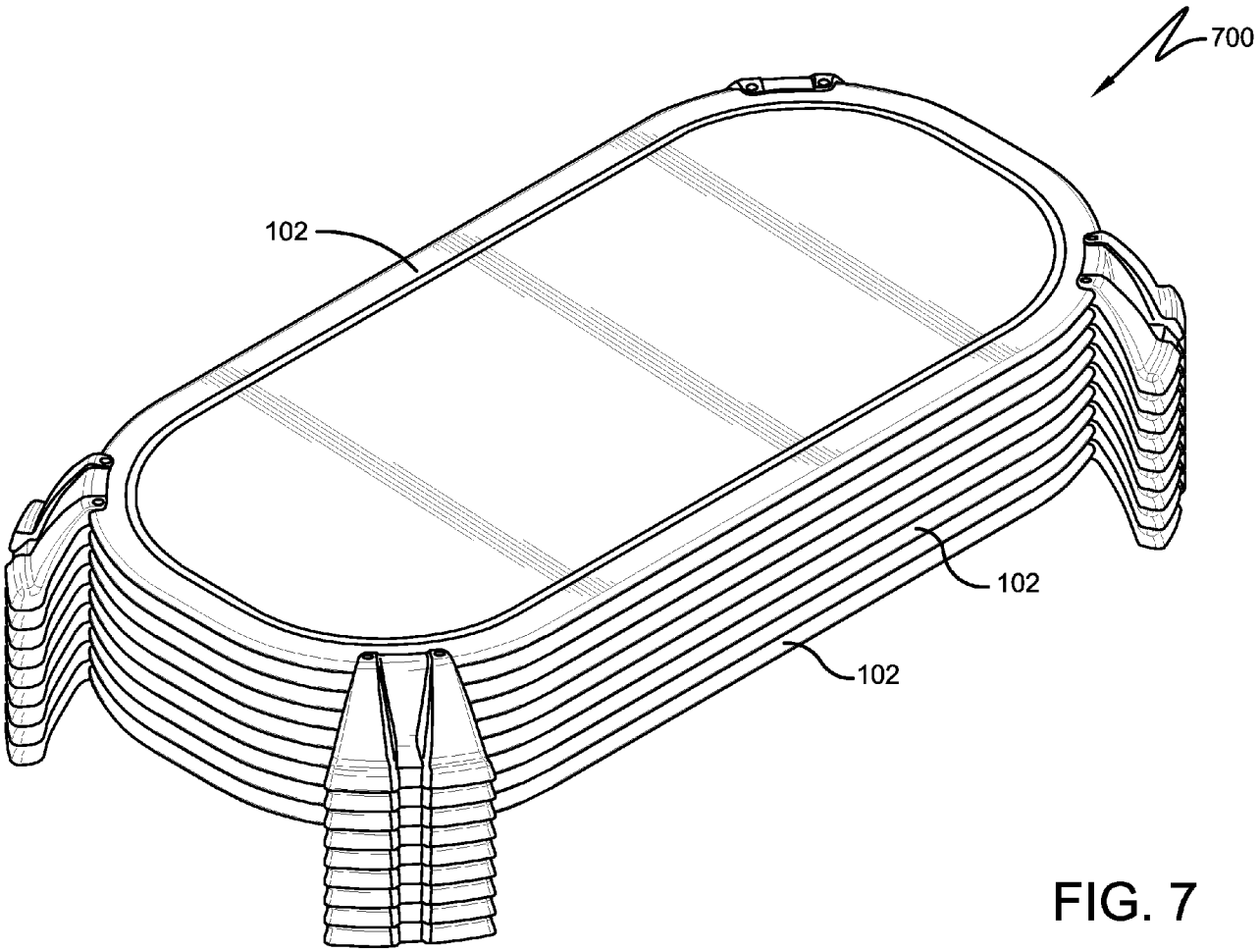
FIG. 7 is an isometric view of a plurality of stacked cots.

FIG. 7 shows an isometric view in which a plurality of the described cots 102 have been placed in stacked relation for storage. To more clearly show how the configuration of the legs further the stackability of the cots, FIG. 8 shows an isometric cross-sectional view of a plurality of cots stacked together.

Figure 8:
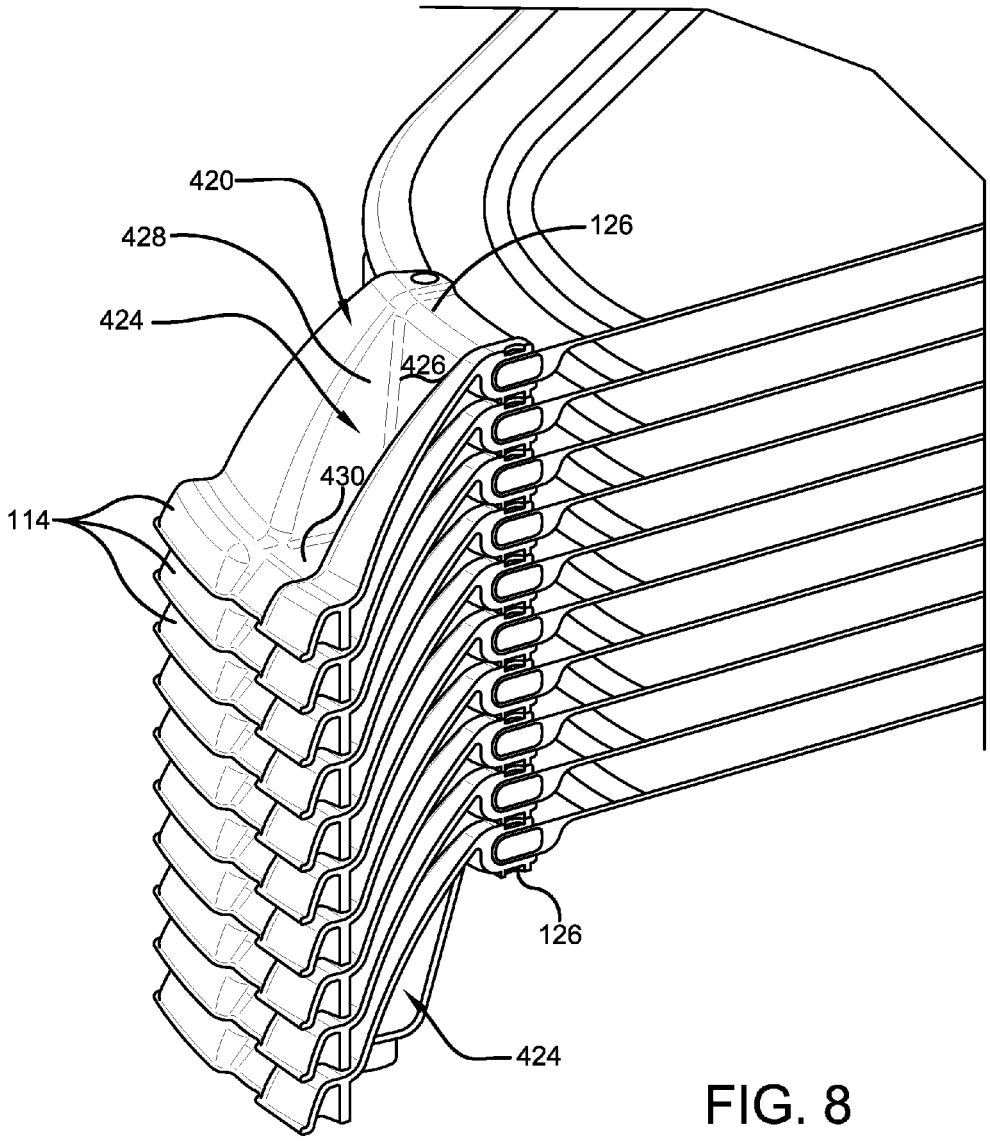
FIG. 8 is a cross-sectional isometric view of a plurality of stacked cots.

As shown in FIG. 8, the legs 114 of the cots are operative to slide over top of each other such that a leg of an upper cot extends adjacent the outside surface of the leg of the cot underneath it. In addition, the walls 426, 428, 430 that bound the channel 424 in the leg of an upper cot are operative to extend into the channel 424 of the leg of the cot underneath it. With this arrangement, the mounted ends 126 are operated to rest in stacked relation on top of each other.

Thus, each additional cot placed on the stack may only increase the height of the stack by about the vertical thickness of the mounted end 126. Such a vertical thickness, for example, may be about 1 inch, whereas the vertical height of a leg when mounted to the frame may be on the order of 5 inches. Thus, the additional incremental height of the stack when an additional cot is added on the stack of cots may only increase the vertical height of the stack by 20% of the total height of each cot in this example. However, it should be appreciated that in alternative embodiments, other dimensions for the vertical thicknesses of the mounted end and the total height of each leg may be used depending on criteria such as the desired height and stiffness of the cot.

Referring to FIG. 5, in this described example, the upper portion of the channel 424 in the outer surface 420 of a leg may include a relatively wider upper portion (adjacent the mounted end 126) which slopes inwardly towards a relatively narrower lower portion (adjacent the foot 116). Also, as shown in FIG. 5, the upper portion of the outside surface 420 of the leg adjacent the mounted end 126 is relatively narrower than the relatively lower portion of the outside surface that is adjacent and/or includes the foot 116. These described characteristics of the legs may assist in stacking cots compactly together. In addition, the described downwardly tapering of the channel 424 and the widening of the outside surface of the leg enables the cots to self align themselves when stacked on top of each other, such that an upper cot does not need to be perfectly aligned with a lower cot before the upper cot is lowered into nesting engagement with a lower cot. In this configuration, the tapered channel 426 may serve to guide the cots into aligned and stacked relation with each other.

In the previously described examples of a cot, the cot has been shown with four legs adjacent the four rounded corners of the frame of the cot. However, it should be noted that this described example is for illustration purposes only and alternative embodiments may have different shapes and/or different numbers of legs.

Figure 9:
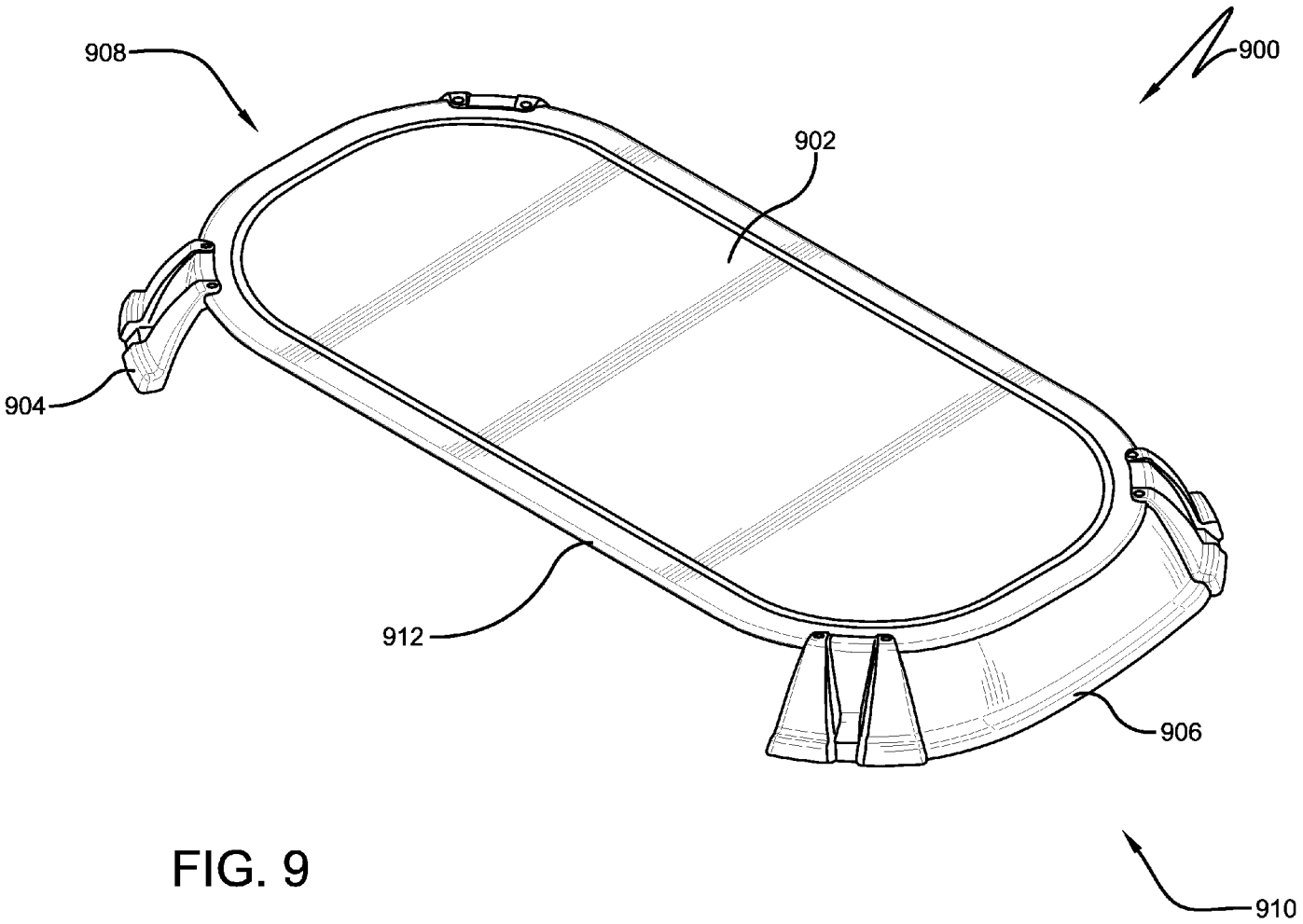
FIG. 9 is an isometric view of an alternative example of a cot for a child.

For example, FIG. 9 depicts an isometric view 900 of an alternative embodiment of a cot 902. In this alternative example, the cot includes only two legs 904, 906 positioned on opposite ends 908, 910 of the frame 912 of the cot. In this example, the legs may have a width that extends across the width of the frame of the cot. However, it should be appreciated that in further alternative embodiments, the legs of the cot may have other sizes relative to the dimensions of the frame of the cot. Also, in a further alternative embodiment, a cot may have only one leg that extends around the entire perimeter of the frame.

Figure 10:
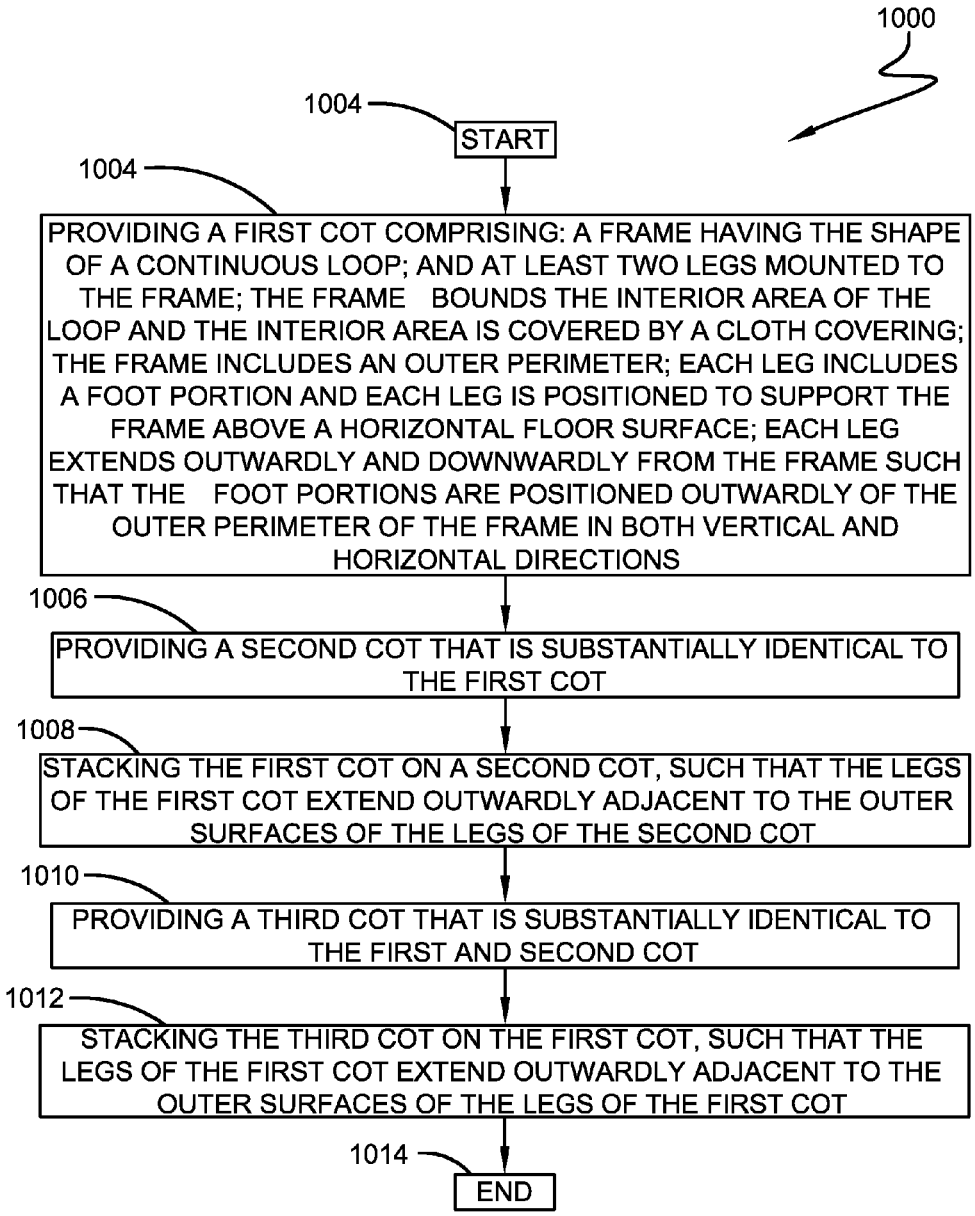
FIG. 10 is a flow diagram that illustrates an example methodology of storing the cots.

With reference now to FIG. 10, example methodologies are illustrated and described. While the methodologies are described as being a series of acts (also called steps) that are performed in a sequence, it is to be understood that the methodologies are not limited by the order of the sequence. For instance, some acts may occur in a different order than what is described herein. In addition, an act may occur concurrently with another act. Furthermore, in some instances, not all acts may be required to implement a methodology described herein.

Referring now to FIG. 10, a methodology 1000 regarding the previously described cot is illustrated. The methodology 1000 begins at 1002, and at 1004 includes step of providing a first cot comprising: a frame having a shape of a continuous loop; and at least two legs mounted to the frame. As discussed previously, the frame bounds an interior area of the loop and the interior area is covered by a fabric covering. Also, the frame includes an outer perimeter. Each leg includes a foot portion and each leg is positioned to support the frame above a horizontal floor surface with the foot portions of each leg in contact with the floor surface. Also, each leg extends outwardly and downwardly from the frame such that the foot portions are positioned outwardly of the outer perimeter of the frame in both vertical and horizontal directions.

This example methodology may include a step 1006 of providing a second cot that is substantially identical to the first cot. Also, this example methodology may include a step 1008 of stacking the first cot on a second cot, such that the legs of the first cot extend outwardly adjacent outer surfaces of the legs of the second cot.

In addition, this described methodology may include a step 1010 of providing a third cot that is substantially identical to the first and second cots followed by a step 1012 of stacking the third cot on the first cot such that the legs of the third cot extend outwardly adjacent outer surfaces of the legs of the first cot. At step 1014 the methodology may end. It should be appreciated that these described steps may be repeated in order to produce a stack of many cots having a compact footprint.

It is noted that several examples have been provided for purposes of explanation. These examples are not to be construed as limiting the hereto-appended claims. Additionally, it may be recognized that the examples provided herein may be permutated while still falling under the scope of the claims.

What is claimed is:

1. An apparatus comprising:

a cot comprising:

a frame having a shape of a continuous loop, wherein the frame bounds an interior area of the loop, wherein the interior area is covered by a fabric covering, wherein the frame includes an outer perimeter, at least two legs in operative connection with the frame, wherein each leg includes a foot portion, a mounted end that is in operative connection with the frame, an outer surface, wherein the outer surface includes a channel that extends between the mounted end and the foot portion, wherein in an operative position the at least two legs are positioned to support the frame above a horizontal floor surface with the foot portions of each leg positioned upon the floor surface, wherein in an operative position each leg extends outwardly and downwardly from the frame such that the foot portions are positioned outwardly of the outer perimeter of the frame in both vertical and horizontal directions.

2. The apparatus according to claim 1, wherein the interior area of the cot is covered by a fabric covering such that there is no aperture through the loop that is larger than ⅛th inch.

3. The apparatus according to claim 2, wherein the frame of the cot includes four spaced apart rounded corner portions, wherein the frame includes four legs in operative connection respectively with the four rounded corner portions of the frame.

4. The apparatus according to claim 2, wherein the frame of the cot includes opposed ends, wherein the frame includes only two legs in operative connection respectively with the two opposed ends of the frame.

5. The apparatus according to claim 3, wherein the mounted end of each leg includes a further channel, wherein each corner portion extends in a further channel of a respective leg.

6. The apparatus according to claim 5, wherein the corner portions of the frame have a curvature in a horizontal direction when the foot portions of each leg are positioned upon the horizontal floor surface, wherein the further channel of the mounted end of each leg includes an inner wall that has a curved contour in the horizontal direction, wherein the curved contour in the horizontal direction generally corresponds to a curvature of the corner portion of the frame that extends in the further channel of the mounted end of each leg.

7. The apparatus according to claim 5, wherein the mounted end of each leg includes at least two spaced apart apertures that are positioned on opposed sides of the further channel in the mounted end, wherein each leg includes at least one fastener that is positioned to extend through the at least two spaced apart apertures and through the corner portion of the frame to which the mounted end is operatively connected.

8. The apparatus according to claim 7, wherein the mounted end of each leg includes at least two sets of the two spaced apart apertures, wherein the at least two sets are spaced apart along the further channel of the mounted end of each leg in the horizontal direction, wherein each leg includes at least two fasteners that are respectively positioned to extend through the at least two spaced apart apertures of the at least two sets.

9. The apparatus according to claim 7, wherein the foot of each leg is wider than the mounted end of each leg.

10. The apparatus according to claim 1, wherein the cot corresponds to a first cot, wherein the first cot is configured to be stacked on a substantially identical second cot, such that the legs of the first cot extend outwardly adjacent outer surfaces of the legs of the second cot.

11. The apparatus according to claim 10, wherein the first cot is configured to receive a substantially identical third cot stacked thereon, such that the legs of the third cot extend outwardly adjacent outer surfaces of the legs of the first cot.

12. The apparatus according to claim 11, further comprising the second cot and the third cot, wherein the first cot is stacked on the second cot, wherein the third cot is stacked on the first cot.

13. The apparatus according to claim 1, wherein the foot is configured to receive a pad, wherein the pad is configured to enable the foot to slide on the horizontal floor surface.

14. An apparatus comprising:

a cot comprising:

a frame, wherein the frame has a shape of a continuous loop, and includes rounded corner portions, wherein the frame bounds an interior area of the loop, wherein the interior area includes a fabric covering, a plurality of legs, wherein each leg includes a mounted end that is in operative connection with a respective rounded corner portion of the frame, wherein each leg includes an outer surface, wherein the outer surface includes curved portions that extends outwardly and downwardly from the mounted end, wherein each outer surface includes a channel that extends inwardly of the curved portions.

15. The apparatus according to claim 14, wherein the mounted end of each leg includes a further channel, wherein a respective corner portion extends in a respective further channel, wherein each mounted end includes at least two spaced apart apertures positioned on opposed sides of the further channel, wherein each leg includes at least one fastener that is positioned to extend through the at least two spaced apart apertures and through the respective corner portion of the frame to which the mounted end is operatively connected.

16. The apparatus according to claim 14, wherein each leg includes a foot portion, wherein the legs are positioned to support the frame above a horizontal floor surface with the foot portions of each leg positioned upon the floor surface, wherein the foot portions are positioned outwardly of the frame in both vertical and horizontal directions.

17. An apparatus comprising:

a cot comprising:

a frame having a shape of a continuous loop, wherein the frame bounds an interior area of the loop, wherein the interior area is covered by a fabric covering, wherein the frame includes an outer perimeter, at least two legs in operative connection with the frame, wherein each lea includes a foot portion, wherein the at least two legs are positioned to support the frame above a horizontal floor surface, wherein each leg extends outwardly and downwardly from the frame, wherein each leg includes an outer surface and a mounted end, wherein the mounted end is in operative connection with the frame, wherein the outer surface of each leg includes curved portions that are curved as the outer surface slopes downwardly and outwardly from the mounted end, wherein the outer surface of each leg includes a channel that is positioned inwardly of the curved portions.

18. The apparatus according to claim 17, wherein the frame of the cot includes rounded corner portions, wherein the legs are in operative connection respectively with the rounded corner portions of the frame, wherein the mounted end of each leg includes a channel, wherein the corner portions extend in the channels of the legs, wherein the legs are positioned to support the frame above a horizontal floor surface with the foot portions of each leg positioned upon the floor surface, wherein the foot portions are positioned outwardly of the outer perimeter of the frame in both vertical and horizontal directions.

* * * * *